US011098597B2

(12) United States Patent
Maltson et al.

(10) Patent No.: US 11,098,597 B2
(45) Date of Patent: Aug. 24, 2021

(54) INTERNALLY-COOLED TURBOMACHINE COMPONENT

(71) Applicant: Siemens Aktiengesellschaft, Munich (DE)

(72) Inventors: John David Maltson, Skellingthorp (GB); Almir Ajkunic, Norrkoping (SE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 16/764,998

(22) PCT Filed: Nov. 15, 2018

(86) PCT No.: PCT/EP2018/081316
§ 371 (c)(1),
(2) Date: May 18, 2020

(87) PCT Pub. No.: WO2019/105743
PCT Pub. Date: Jun. 6, 2019

(65) Prior Publication Data

US 2020/0325782 A1 Oct. 15, 2020

(30) Foreign Application Priority Data

Nov. 29, 2017 (EP) ..... 17204409

(51) Int. Cl.
*F01D 5/18* (2006.01)
*F01D 25/12* (2006.01)

(52) U.S. Cl.
CPC ..... *F01D 5/187* (2013.01); *F01D 25/12* (2013.01); *F05D 2230/21* (2013.01);
(Continued)

(58) Field of Classification Search
CPC ..... F01D 5/187; F01D 25/12; F05D 2230/21; F05D 2240/11; F05D 2240/81;
(Continued)

(56) References Cited

U.S. PATENT DOCUMENTS 4,278,400 A 7/1981 Yamarik et al.
7,478,994 B2 * 1/2009 Cunha ..... F01D 5/188 416/97 R (Continued)

FOREIGN PATENT DOCUMENTS

RU 2575260 C2 2/2016

OTHER PUBLICATIONS

International search report and written opinion dated Feb. 20, 2019 for corresponding PCT/EP2018/081316.

*Primary Examiner* — Igor Kershteyn

(57) ABSTRACT

An internally-cooled turbomachine component, having: a main body with a first end wall, a second end wall spaced apart from the first end wall, and a sidewall which extends between the first end wall and the second end wall such that the first end wall, the second end wall and the sidewall define a cooling passage extending between a fluid inlet and a fluid outlet, a pedestal bank with a plurality of pedestals which span the cooling passage between the first end wall and the second end wall, wherein the pedestal bank is spaced from the sidewall to define a flow channel therebetween; and a flow guide for directing cooling flow away from the flow channel, the flow guide extending from the flow channel into the pedestal bank.

17 Claims, 5 Drawing Sheets

(52) U.S. Cl.
CPC .. *F05D 2250/711* (2013.01); *F05D 2250/712* (2013.01); *F05D 2260/201* (2013.01); *F05D 2260/22141* (2013.01)

(58) Field of Classification Search
CPC ..... F05D 2250/711; F05D 2250/712; F05D 2260/201; F05D 2260/2212
See application file for complete search history.

(56) References Cited

U.S. PATENT DOCUMENTS

| | | | | |
|---|---|---|---|---|
| 7,686,580 | B2 * | 3/2010 | Cunha | F01D 5/186 416/97 R |
| 9,228,439 | B2 * | 1/2016 | Pointon | F01D 5/18 |
| 9,249,675 | B2 * | 2/2016 | Smith | F01D 5/188 |
| 2002/0021966 | A1 | 2/2002 | Kvasnak et al. | |
| 2009/0068021 | A1 | 3/2009 | Liang | |

* cited by examiner

INTERNALLY-COOLED TURBOMACHINE COMPONENT

CROSS REFERENCE TO RELATED APPLICATIONS

This application is the US National Stage of International Application No. PCT/EP2018/081316 filed 15 Nov. 2018, and claims the benefit thereof. The International Application claims the benefit of European Application No. EP17204409 filed 29 Nov. 2017. All of the applications are incorporated by reference herein in their entirety.

FIELD OF INVENTION

The present disclosure relates to an internally-cooled turbomachine component.

In particular the disclosure is concerned with a turbomachine component which may be provided as an aerofoil component.

BACKGROUND

Gas turbines generally include rows of stationary vanes fixed to the casing of the gas turbine and a rotor with a number of rows of rotating rotor blades fixed to a rotor shaft. Hot and pressurised working fluid flows through the rows of vanes and blades, thus imparting momentum to the rotor blades but also transferring a significant amount of heat to the vanes and blades in particular.

Internally-cooled turbomachine components, such as the vanes or blades, may include a cooling passage extending through the component. In order to improve heat transfer to a cooling flow through the cooling passage, it is known to provide a bank of pedestals in the cooling passage. The pedestal bank comprises individual pedestals distributed in the cooling passage in a regular arrangement, because the absence of pedestals in a particular location generates a void which allows the cooling flow to circumvent certain pedestals or the pedestal bank altogether. Thus the presence a void may result in an overall reduction in cooling and may lead to increased temperature gradients. Such a void may be a particular concern in the region between the pedestal bank and a sidewall which bounds the cooling passage.

Conventionally this problem is in part overcome with the provision of half pedestals, i.e. generally semi-cylindrical pedestals, are formed on the sidewall to extend into the cooling passage. The half pedestals resemble the pedestals and so reduce the size of the void between the sidewall and the pedestal bank. Thus cooling flow is distributed more evenly through the pedestal bank. It may not always be possible, however, to form half pedestals because of, for example, limitations of the particular alloys from which the component is formed which may result in structural defects. It may be desirable to avoid the need of the half pedestals, especially where the component is cast because this would simplify the ceramic core and improve the casting yield. Yet dispensing with half pedestals adversely affects the cooling flow.

Hence an internally-cooled turbomachine component possessing an improved cooling passage arrangement is highly desirable.

SUMMARY

According to the present disclosure there is provided an apparatus as set forth in the appended claims. Other features of the invention will be apparent from the dependent claims, and the description which follows.

Accordingly there is provided an internally-cooled turbomachine component, comprising: a main body (200) comprising; a first end wall (210), a second end wall (212) spaced apart from the first end wall (210), and a sidewall (220) which extends between the first end wall (210) and the second end wall (212) such that the first end wall (210), the second end wall (212) and the sidewall (220) define a cooling passage (230) extending between a fluid inlet (202) and a fluid outlet (204), a pedestal bank (240) comprising a plurality of pedestals (241) which span the cooling passage (230) between the first end wall (210) and the second end wall (212), wherein the pedestal bank (240) is spaced from the sidewall (220) to define a flow channel (250) therebetween; and a flow guide (260) for directing cooling flow away from the flow channel (250), the flow guide (260) extending from the flow channel (250) into the pedestal bank (240). The flow guide (260) has a leading edge (270), a trailing edge (272) and a centre-line (274), the centre-line (274) intersects both the leading edge (270) and the trailing edge (272), a tangent (276) of the centre-line (274) at the intersection with the leading edge (270) has an angle θ to the sidewall (220) and/or flow direction (F1, F2) in the range 0° to 45°.

The flow guide (260) may have a second tangent (278) of the centre-line (274) at the intersection with the trailing edge (272) and which has an angle ϕ to the sidewall (220) and/or flow direction (F1, F2) in the range 20° to 45°.

The angle ϕ may be greater than or equal to angle θ.

The flow guide 260 is configured to redirect cooling flow within the cooling passage 230 and so draw peripheral flow F1 from the flow channel 250 into the pedestal bank 240. Thus the flow guide 260 improves cooling by reducing the amount of cooling flow circumventing the pedestal bank 240 and reducing high temperature gradients about the flow channel 250.

The pedestal bank (240) may comprise a first row (242) of pedestals, which is adjacent to and spaced apart from the sidewall (220), and a second row (244) of pedestals, which is spaced apart from the first row (242), the first row (242) located adjacent to the sidewall (220), and wherein the flow guide (260) extends from the first row (242) to the second row (244).

The pedestal bank (240) may comprise a first column (246) of pedestals (241) and a second column (248) of pedestals, the pedestals (241) of each column (246, 248) generally aligned, and the first column (246) located upstream of the second column (248), and wherein the flow guide (260) extends from the first column (246) to the second column (248).

The flow guide (260) may comprise a head portion (263), a tail portion (264), and an elongate middle portion (265) extending between the head portion (263) and the tail portion (264), and wherein the middle portion (265) is configured to define an inner side (266) facing the pedestal bank (240) and an outer side (267) facing the sidewall (220).

The elongate middle portion (265) may extends a first distance in the flow direction (F1, F2, F3) and a second distance perpendicular to the flow direction (F1, F2, F3), wherein the first distance is equal to or greater than the second distance.

A first section (268) of the inner side (266) may be concave.

A second section (269) of the inner side (266) may be convex, the second section (269) provided closer to the tail portion (264) than the head portion section (263).

The head portion (263) may be provided as a rounded end of the flow guide (260) and the tail portion (264) is provided as a pointed end of the flow guide (260), the tail portion (264) being located downstream of the head portion (263).

The flow guide (260) may extend all of the way across the cooling passage (230) between the first end wall (210) and the second end wall (212).

The flow guide (260) may be spaced apart from the sidewall (220).

The sidewall (220) may be substantially planar.

The turbomachine component may comprise a plurality of flow guides (260).

The plurality of flow guides (260) is arranged as a first row (261) of flow guides (260) and a second row (262) of flow guides (260).

The plurality of flow guides arranged as the first row of flow guides and/or the second row of flow guides may be aligned in the direction parallel to the sidewall and/or in the flow direction).

The first row (261) of flow guides (260) may have a first spacing between neighbouring pedestals in the row, the second row (262) of flow guides may have a second spacing between neighbouring pedestals in the row, wherein the first spacing is substantially equal to the second spacing and the first row (ref) of flow guides (260) is offset relative to the second row (262) of flow guides (260) by approximately half of the first spacing.

According to another example there is provided a ceramic core for casting a turbomachine component as described above.

BRIEF DESCRIPTION OF THE DRAWINGS

Examples of the present disclosure will now be described with reference to the accompanying drawings, in which.

DETAILED DESCRIPTION

The present disclosure relates to a component, for example a stator vane or a rotor blade, for use in a turbomachine, such as a gas turbine.

Figure 1:
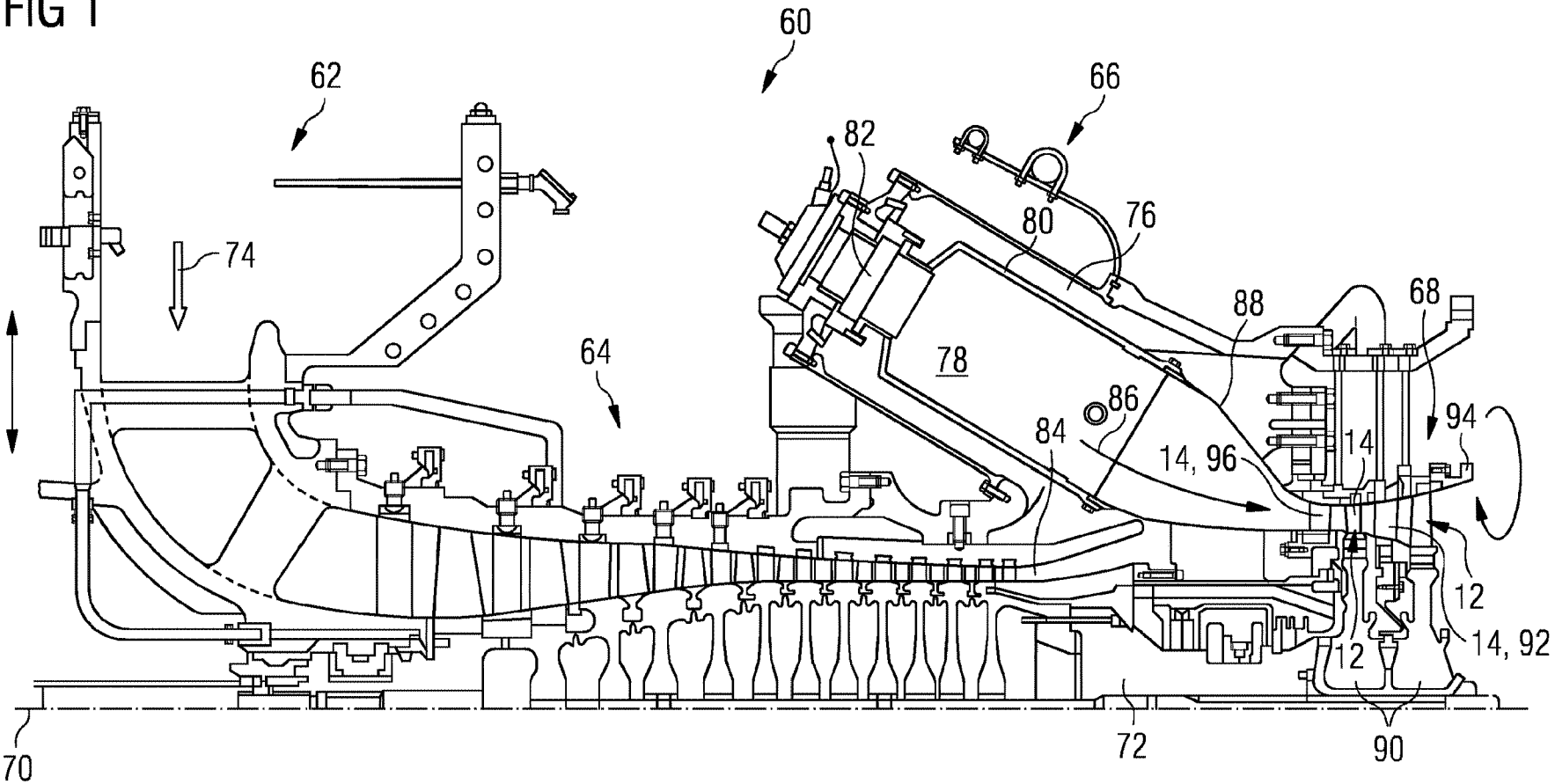
FIG. 1 is a schematic representation of an example of a turbomachine.
Figure 2:
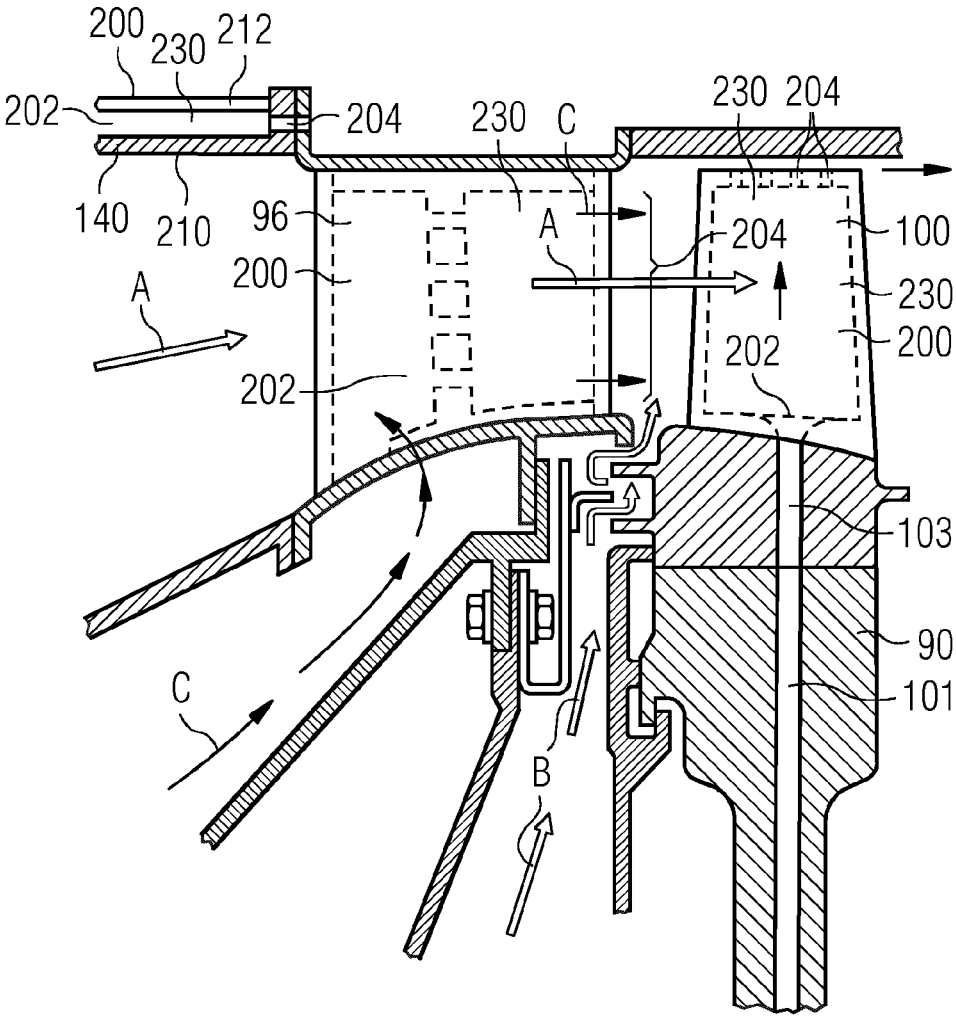
FIG. 2 shows an enlarged region of a section of a turbine of the turbomachine shown in FIG. 1.

By way of context, FIGS. 1 and 2 show known arrangements to which features of the present disclosure may be applied.

FIG. 1 shows an example of a gas turbine engine 60 in a sectional view, which illustrates the nature of the stator vanes, the rotor blades and the environment in which they operate. The gas turbine engine 60 comprises, in flow series, an inlet 62, a compressor section 64, a combustion section 66 and a turbine section 68, which are generally arranged in flow series and generally in the direction of a longitudinal or rotational axis 70. The gas turbine engine 60 further comprises a shaft 72 which is rotatable about the rotational axis 70 and which extends longitudinally through the gas turbine engine 60. The rotational axis 70 is normally the rotational axis of an associated gas turbine engine. Hence any reference to "axial", "radial" and "circumferential" directions are with respect to the rotational axis 70.

The shaft 72 drivingly connects the turbine section 68 to the compressor section 64.

In operation of the gas turbine engine 60, air 74, which is taken in through the air inlet 62 is compressed by the compressor section 64 and delivered to the combustion section or burner section 66. The burner section 66 comprises a burner plenum 76, one or more combustion chambers 78 defined by a double wall can 80 and at least one burner 82 fixed to each combustion chamber 78. The combustion chambers 78 and the burners 82 are located inside the burner plenum 76. The compressed air passing through the compressor section 64 enters a diffuser 84 and is discharged from the diffuser 84 into the burner plenum 76 from where a portion of the air enters the burner 82 and is mixed with a gaseous or liquid fuel. The air/fuel mixture is then burned and the combustion gas 86 or working gas from the combustion is channeled via a transition duct 88 to the turbine section 68.

The turbine section 68 may comprise a number of blade carrying discs 90 or turbine wheels attached to the shaft 72. In the example shown, the turbine section 68 comprises two discs 90 which each carry an annular array of turbine assemblies 12, which each comprises an aerofoil 14 embodied as a turbine blade 100 (shown in FIG. 2). Turbine cascades 92 are disposed between the turbine blades 100. Each turbine cascade 92 carries an annular array of turbine assemblies 12, which each comprises an aerofoil 14 in the form of guiding vanes (i.e. stator vanes 96, shown in FIG. 2), which are fixed to a stator 94 of the gas turbine engine 60.

FIG. 2 shows an enlarged view of a stator vane 96 and rotor blade 100. Arrows "A" indicate the direction of flow of combustion gas 86 past the aerofoils 96,100. Arrows "B" show air flow routes provided for sealing. Arrows "C" indicate cooling air flow paths through a flow inlet 202 to a flow outlet 204 via a cooling passage 230 in the stator vane 96. Cooling flow passages 101 may be provided in the rotor disc 90 which extend radially outwards to feed and air flow passage 103 the rotor blade 100. The air flow passages 103 feed a flow inlet 202 to a cooling passage 230 which exhausts at a flow outlet 204 which (in the example shown) is in the tip of the blade.

Also shown in FIG. 2 is a heatshield 140 which defines a part of the turbine flow path "A". It may also be provided with a flow inlet 202, cooling passage 230 and flow outlet 204 to promote cooling.

The combustion gas 86 from the combustion chamber 78 enters the turbine section 68 and drives the turbine blades 100 which in turn rotate the shaft 72 to drive the compressor. The guiding vanes 96 serve to optimise the angle of the combustion or working gas 86 on to the turbine blades.

Figure 3:
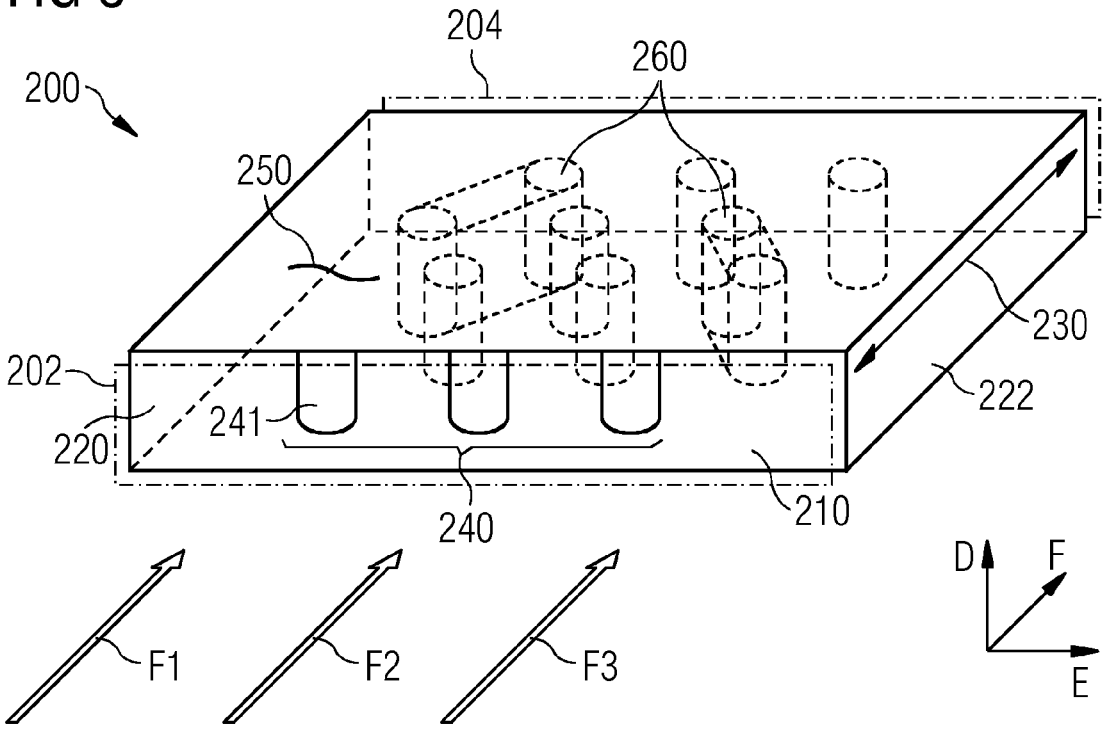
FIG. 3 is a schematic perspective view of a main body of an exemplary turbomachine component.

FIG. 3 shows a perspective view of an internally-cooled turbomachine component, such as a rotor blade 100, a stator vane 96 and/or heatshield 140 as shown in FIG. 2.

Each of the examples of a rotor blade 100, stator vane 96 and/or heatshield 140 (i.e. "the component") comprises a main body 200 having a fluid inlet 202 and a fluid outlet 204. The terminology 'fluid inlet' and 'fluid outlet' may be taken to mean a single inlet and/or outlet, or a plurality of inlets and/or outlets, for example a plurality of apertures arranged to form a single inlet/outlet.

The main body 200 comprises a first end wall 210 and a second end wall 212. The first end wall 210 and the second end wall 212 define opposite ends of the main body 200 along a first direction indicated by arrow "D" in FIG. 3. Hence in the example a rotor blade 100 or stator vane 96, the first end wall 210 and second end wall 212 may be walls which define the suction side and pressure side of the aerofoil. In the example of the heatshield 140, the first end wall 210 and second end wall 212 may define radially inner and outer surfaces of the heatshield 140, as shown in FIG. 2.

The main body 200 comprises a first sidewall 220 and second sidewall 222. The sidewalls 220, 222 are formed at either side of the main body 200 and thus define opposite sides of the main body 200 along a second direction, as indicated by arrow "E" in FIG. 3, which is perpendicular to the first direction "D". Hence in the example a rotor blade 100 or stator vane 96, the first sidewall 220 and second sidewall 222 may define the leading edge or trailing edge, or (depending on the desired direction of flow) the tip or a platform, or form another part of an internal structure of the vane 96 or blade 100. In the example of the heatshield 140, the first sidewall 220 and second sidewall 222 may define circumferentially spaced apart edge walls the heatshield 140.

By way of example, the details of the first sidewall 220 which will be referred to as 'the sidewall 220' for ease of reference. The description applies equally to the second sidewall 222.

According to the present example, the sidewall 220 is generally planar. That is to say, the sidewall 220 may as a whole be angled, inclined or curved relative to the other walls but there are no protrusions extending from or recesses extending into the sidewall 220 other than those described below.

The plurality of walls 210, 212, 220, 222 is configured to define the internal cooling passage (or "chamber") 230 extending through the main body 200. The cooling passage 230 extends between the fluid inlet 202 and the fluid outlet 204. A height of the cooling passage 230 is defined along the first direction "D", while a width of the cooling passage 230 is defined along the second direction "E". A length of the cooling passage 230 is defined along a direction indicated by arrow "F" in FIG. 3, perpendicular to both the first direction "D" and the second direction "E".

In use heat is transferred from the main body 200 to a suitable cooling medium. The cooling medium may comprise air. The cooling flow enters the cooling passage 230 through the fluid inlet 202, generally following a flow direction "F" (or 'third direction'), which is perpendicular to the first direction "D" and the second direction "E", through the cooling passage 230, and ultimately exits through the fluid outlet 204. The flow direction is indicated by the arrows "F1", "F2", "F3".

A pedestal bank 240 is provided in the cooling passage 230 to optimise heat transfer between the main body 200 and the cooling flow. The pedestal bank 240 is configured to introduce serpentine flow paths and increase the surface area available for heat exchange.

Figure 4:
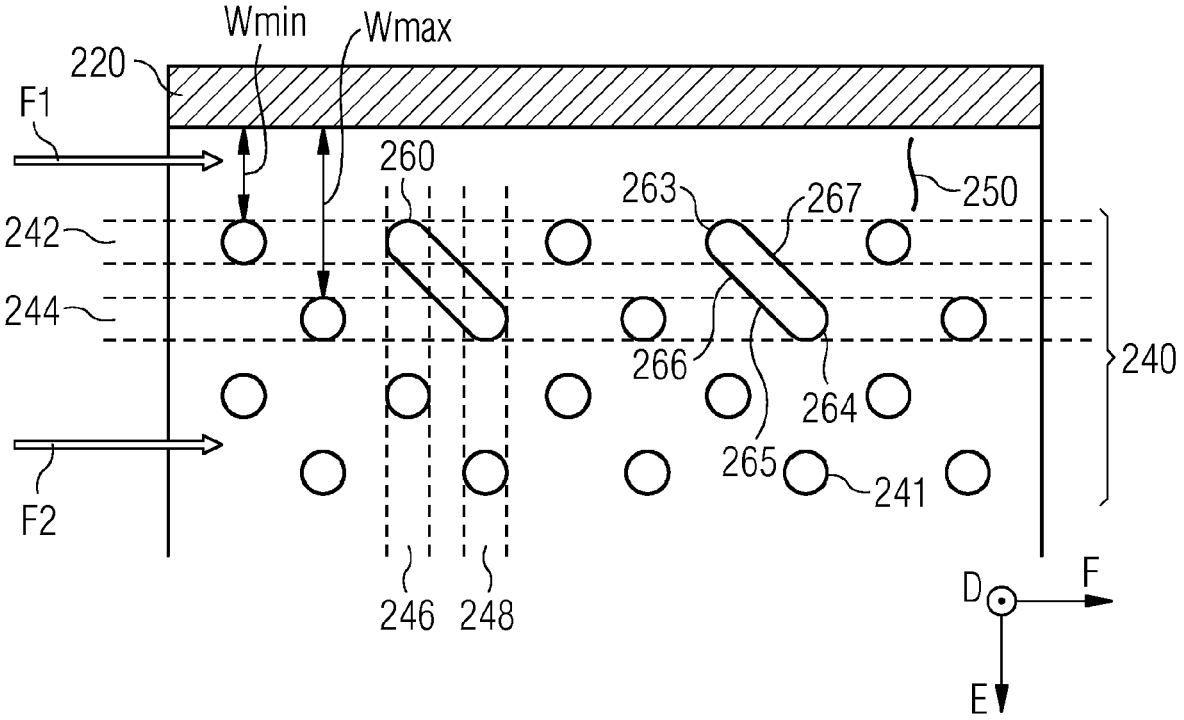
FIG. 4 is a plan view of a cooling passage formed by a main body.
Figure 5:
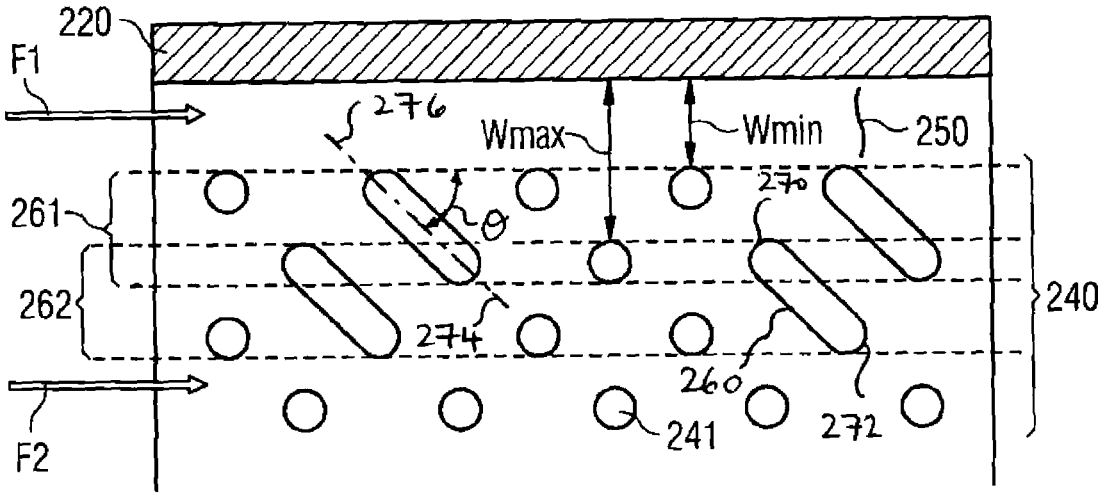
FIG. 5 is a plan view of a cooling passage of a different main body.

FIG. 4 shows a partially broken-away perspective view of the main body 200. The pedestal bank 240 comprises a plurality of individual spaced-apart pedestals 241. In the present example, the pedestals 241 are arranged in rows and columns, as illustrated in FIG. 5, including a first row 242, a second row 244, a first column 246 and a second column 248. The pedestals 241 of each row and column are generally provided in sequence or aligned. Each row and each column define approximately the same angle which, according to the present example, is approximately 90° (degrees angle).

The first row 242 extends beside (or 'along') the sidewall 220, and is spaced apart from and immediately adjacent to the sidewall 220. That is to say, among the plurality of rows the first row 242 is closest to the sidewall 220. According to the present example, the first row 242 extends generally parallel to the sidewall 220. The second row 244 is immediately adjacent and closest to the first row 242, and extends beside and, as the case may be, parallel to the first row 242. The first column 246 and the second column 248 are arranged similarly. Thus each pedestal 241 is part of one row and one column.

The pedestal bank 240 spans the cooling passage 230 between the first end wall 210 and the second end wall 212. That is, each pedestal 241 of the pedestal bank 240 extends in the first direction "D", extending all of the way from the first end wall 210 to the second end wall 212. In other words, the height of the pedestals 241 corresponds to the height of the cooling passage 230. Thus the serpentine flow paths are created by forcing the cooling flow impinging on the pedestal bank 240 around the individual pedestals 241.

A flow channel 250 (or 'void') is formed between the sidewall 220 and the first row 242 of pedestals 241, which is adjacent to the sidewall 220. The void 250 is defined by the absence of features which may interrupt flow, for example pedestals 241 beside the sidewall 220 and/or half pedestals formed on the sidewall 220.

The flow channel 250 is defined between the sidewall 220 and the pedestal bank 240. According to the present example, the pedestal bank 240 comprises columns 246, 248 which are offset relative to each other by half the pedestal spacing and, thus, the flow channel 250 possesses a maximal width Wmax and a minimal width Wmin. The maximal width Wmax may be equal to the spacing between adjacent pedestals 241 of the columns 246, 248 of the pedestal bank 240, and the minimal width Wmin may be about half the spacing between adjacent pedestals 241 of the columns 246, 248.

Hence a portion of the cooling flow which passes through the cooling passage 230 along the flow channel 250, generally following the arrow F1, encounters no pedestals 241. Accordingly, this portion of cooling flow passes through the cooling passage 230 unhindered by pedestals 241, whereas cooling flow following arrow F2 impinges on the pedestal bank 240. Thus a local high pressure area is formed as a result of the impingement and, in the absence of the features of the present disclosure, a local low pressure area is formed as a result of the unhindered flow through the flow channel 250.

A flow guide 260 is located in the cooling passage 230. The flow guide 260 is configured to redirect cooling flow F1, F2 within the cooling passage 230 and, in particular, configured to direct cooling flow from the flow channel 250 into the pedestal bank 240. As shown in FIG. 3, pedestals 241 of the pedestal bank 240 are located upstream and/or downstream of the flow guide 260. In some examples, the flow guide 260 is located between pedestals 241 located both upstream and downstream of the flow guide 260.

The flow guide 260 spans the cooling passage 230 from the first end wall 210 to the second end wall 212, i.e. extends all the way from the first end wall 210 to the second end wall 212. In other words, the flow guide 260 has the height of the cooling passage 230.

The flow guide 260 extends from the flow channel 250 into the pedestal bank 240. Accordingly, the flow guide 260 is elongate. According to the present example, the flow guide 260 spaced from the sidewall 220 without being provided in the flow channel 250. Instead the flow guide 260 extends from the vicinity of the flow channel 250 and extends into the pedestal bank 240.

According to the present example, a plurality of flow guides 260 is provided in the cooling passage 230. Another flow guide 260 is provided downstream of the flow guide 260, with both flow guides separated by a pedestal 241. The plurality of flow guides 260 is arranged sequentially along the periphery of the pedestal bank 240 to define a first row 261 of flow guides 260. According to a different example discussed below, a second row 262 of flow guides 260 is also provided.

A head portion (or 'first end') 263 of the flow guide 260 is located closer to the sidewall 220 than a tail portion (or 'second end') 264 of the flow guide 260. In other words, the flow guide 260 extends into the pedestal bank 240 and away from the sidewall 220.

According to the present example, the flow guide 260 and the pedestal bank 240 have approximately the same separation to the sidewall 220. That is to say, the first row 242 of pedestals and the head portion 263 of the flow guide 260 are spaced from the sidewall 220 by approximately the same distance. Thus the head portion 263 of the flow guide 260 is located at the periphery of the pedestal bank 240, while the tail portion 264 is located within the pedestal bank 240.

A middle portion 265 of the flow guide 260 extends between the head portion 263 and the tail portion 264. According to the present example, the middle portion 265 is generally elongate. The elongate middle portion 265 extends a first distance in the third direction "F", and a second distance in the second direction "E", which corresponds to the width of the cooling passage 230. That is to say, the first distance of the middle portion 265 is along the cooling passage 230, while the second distance of the middle portion 265 is across the cooling passage 230. According to the present example, the first distance and the second distance are substantially equal. According to other examples, the first distance is greater than the second distance.

The flow guide 260 possesses a length such that the flow guide 260 spans multiple rows 242, 244 of pedestals 241 and multiple columns 246, 248 of pedestals 241. For example, the flow guide 260 may span at least two rows 242, 244 and two columns 246, 248. According to the present example, the flow guide 260 extends from the first row 242 of pedestals 241 to the second row 244 of pedestals 241, and from the first column 246 of pedestals 241 to the second column 248 of pedestals 241.

For example, as shown in FIGS. 3 to 5 the flow guide 260 may span two rows 242, 244 and/or two columns 246, 248.

Figure 6:
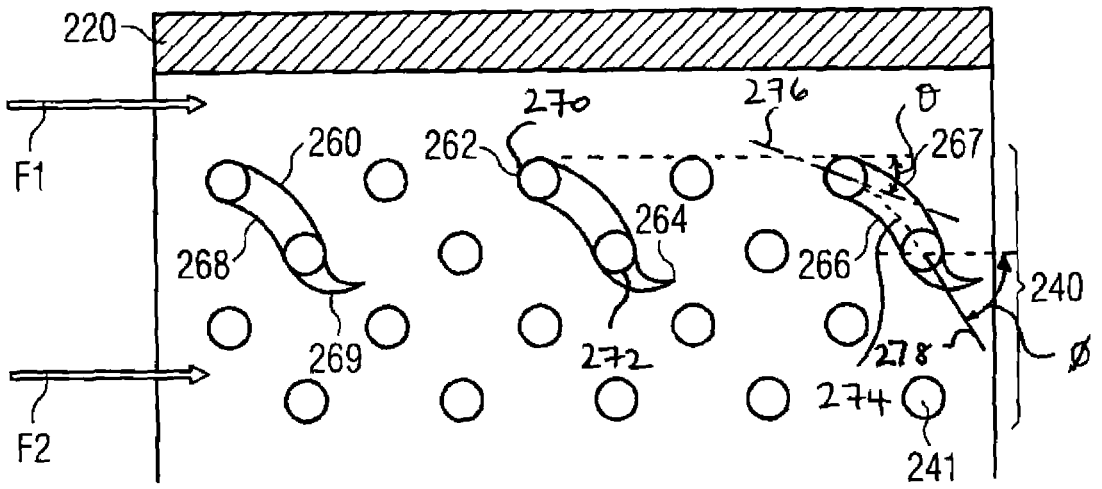
FIG. 6 is a plan view of a cooling passage of another main body.

Alternatively, as shown in FIG. 6, the flow guide 260 may span slightly more than two rows 242, 244 and/or two columns 246, 248.

Figure 7:
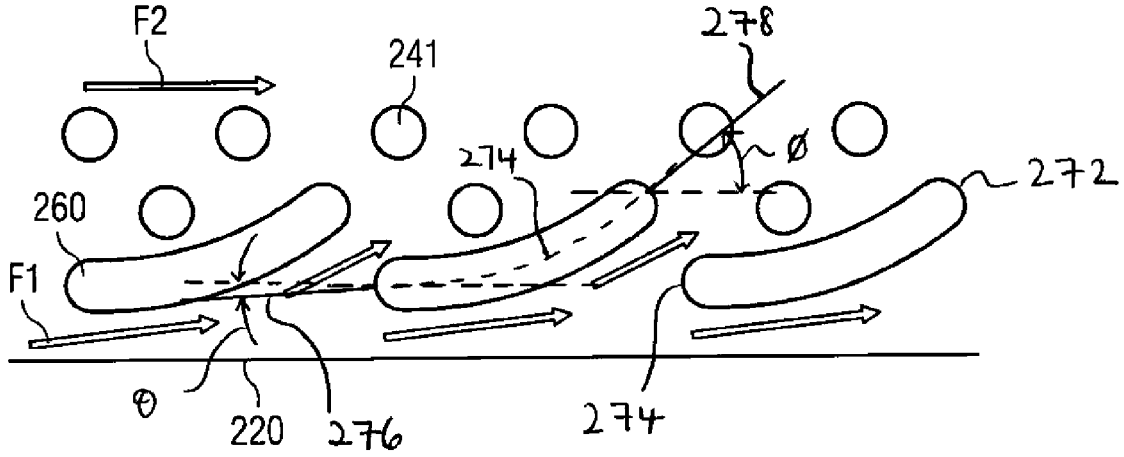
FIG. 7 is a plan view of a further example of a cooling passage.

In a further example, as shown in FIG. 7, the flow guide 260 may span more than two rows 242, 244 and/or two columns 246, 248.

According to the present example, the flow guide 260 extends from the first row 242 of pedestals 241 to the second row 244 of pedestals 241, and from the first column 246 of pedestals 241 to the second column 248 of pedestals 241.

The middle portion 265 defines an inner side 266 of the flow guide 260 and an outer side 267 of the flow guide 260. The inner side 266 generally faces the pedestal bank 240, while the outer side 267 generally faces the sidewall 220. In other words, the sidewall 220 is located towards one side of the flow guide 260, i.e. towards the outer side 267, while the pedestal bank 240 is located towards the other side of the flow guide 260, i.e. towards the inner side 266. According to the present example, the middle portion 265 is generally straight so that the inner side 266 and outer side 267 are substantially straight.

According to the example described above, the head portion 263 is located at the periphery of the pedestal bank 240, and the tail portion 264 is located in the pedestal bank 240. According to other examples, the head portion 263 may be located in the flow channel 250, and/or the tail portion 264 may be located at the periphery of the pedestal bank 240.

According to the example of FIG. 5, another row of flow guides 260 is provided to further optimise the cooling passage 230.

That is to say, the plurality of flow guides 260 is arranged into a first row 261 of flow guides and a second row 262 of flow guides. The term 'row' is understood as in relation to the rows of the pedestal bank 240, in that the first row of flow guides is adjacent and closest to the sidewall 220. The second row of flow guides is adjacent to the first row of flow guides. According to the present example, the flow guides of the first row 261 and the flow guides of the second row 262 are provided in an interspaced arrangement. That is to say, a flow in the flow direction first encounters a member of one of the rows of flow guides, and subsequently a member of the other row of flow guides.

According to FIG. 6, the shape of the flow guide 260 is adapted to further optimise the cooling passage 230. According to this example, the inner side 266 comprises a first section 268 and a second section 269. The first section 268 is concave. The second section 269 is convex, and provided closer to the tail portion 264 than the first portion 268. Thus a cooling flow incident on the flow guide 260 first follows the concave first section 268 and then the convex second section 269 for optimised cooling flow. Conversely, FIG. 6 shows that the outer side 267 possesses a first section which is convex and a second section which is concave.

According to FIG. 6, the shape of the fluid guide 260 is adapted further in that the head portion 263 defines a rounded end, while the tail portion 264 defines a pointed end. The pointed end is a narrower portion of the flow guide 260 than the rounded end. The rounded end is provided upstream and configured to divide the incident cooling flow, whereas the pointed end is provided downstream and configured to recombine the cooling flow.

In operation/use, a cooling flow F1, F2, F3 enters the cooling passage 230 through the fluid inlet 202, passes through the cooling passage 230, and exits the cooling passage 230 through the fluid outlet 204. When passing through the cooling passage 230, the cooling flow separates into a central flow F2 through the pedestal bank 240 and a peripheral flow F1 through the flow channel 250.

The flow guide 260 is configured to redirect the cooling flow into the pedestal bank 240. A portion of the central flow F2 is incident on the flow guide 260 and, thus, redirected from the head portion 263 of the flow guide 260 towards the tail portion 264. This generates a lower pressure region at the head portion 263. The lower pressure region draws peripheral flow F1 from the flow channel 250 towards the pedestal bank 240. That is to say, even where the flow guide 260 is not be located in the flow channel 250 or at the sidewall 220 or extends into the flow channel 250 or to the sidewall 220, the flow guide 260 nevertheless serves to redirect peripheral flow F1 from the flow channel 250 into the pedestal bank 240. Hence, the flow guide 260 draws cooling flow away from the sidewall 220 and out of the flow channel 250.

Put another way, the flow guide 260 directs some, but not all, of the flow passing along the flow channel 250 to the pedestal bank 240.

Referring generally to FIGS. 5, 6 and 7, the flow guide 260 can be further defined relative to the sidewall 220 and/or the flow direction F1, F2. The flow guide 260 has a leading edge 270, a trailing edge 272 and a centre-line 274 which could also be termed a camber line. The centre-line 274 is a line through the geometric centre of the flow guide 260. The centre-line 274 intersects both the leading edge 270 and the trailing edge 272 at respective intersection points. A tangent 276 of the centre-line 274 at the intersection with the leading edge 270 defines an angle θ to the sidewall 220. Broadly, the angle θ is in the range 0° to 45° for all the embodiments shown and described herein. A second tangent 278 of the centre-line 274 at the intersection with the trailing edge 272 defines an angle ϕ to the sidewall 220 in the range 20° to 45°. The angle ϕ is greater than or equal to angle θ in each example.

In FIG. 5, the flow guide 260 is straight such that angle ϕ is equal to angle θ or in other words the tangents 276 and 278 are parallel and coincident with one another. In this example, the centre-line 274 has an angle θ in the range 20° to 45°. In FIGS. 6 and 7, the flow guide 260 is arcuate in the plane shown in the figure. Here the angle θ is in the range 0° to 30° and angle 4 to the sidewall 220 is in the range 20° to 45°. Further, the flow guide 260 may comprise two or more straight portions which are angled relative to one another and effectively is similar to the curved flow guides of FIGS. 6 and 7. Here the flow guide 260 has at least one 'dog-leg' and has an initial angle θ where the cooling flow first impacts the flow guide 260 and a final angle 4 to the sidewall 220 where the cooling flow leaves the flow guide 260.

The orientation and quoted angles θ and angles ϕ of the flow guide 260 are such that a part of the cooling flow F1, F2 is directed from the cooling passage 230 into the pedestal bank 240. Thus the flow guide 260 improves cooling by reducing the amount of cooling flow circumventing the pedestal bank 240 and reducing high temperature gradients about the flow channel 250.

In FIGS. 4-7, the plurality of flow guides 260 is arranged as the first row 261 of flow guides 260 and the first row 261 is aligned in the direction generally parallel to the sidewall 220 and/or in the flow direction F1, F2. Each sequential flow guide 260 in the first row 261 is approximately the same distance from the sidewall 220. Preferably, each sequential flow guide 260 in the first row 261 is spaced apart in the directions of the first row by at least one pedestal 241, although in other embodiments, by 2 or 3 pedestals 241. In some circumstances, there may be no pedestals 241 between each flow guide 260 in the row 261 of flow guides. Furthermore, in the row 261 of flow guides, sequential flow guides 260 may be spaced irregularly with a different number of pedestals or no pedestals therebetween.

In FIG. 5, the second row 262 of flow guides 260 may be configured similarly to the first row 261 of flow guides although as described above the first row (261) of flow guides (260) is offset relative to the second row (262) of flow guides (260).

According to some examples, the main body 200 is manufactured through a casting process using a ceramic core. Manufacturing through casting may be particularly common where the component is provided as an aerofoil and the main body 200 corresponds to a rotor blade or a stator vane.

The strength of the ceramic core is a factor determining the successful casting yield and hence immediately relates to time and cost efficiency of the manufacturing process. Conveniently, a ceramic core for casting the main body 200 possesses a planar side configured for forming the sidewall 220 of the main body 200. In particular, no grooves or notches extend along the full height of the planar sidewall which would otherwise be required for forming half pedestals. Accordingly, a ceramic core for casting the main body 200 may possess improved strength as well as a less complex shape than would otherwise be required when forming half pedestals.

The ceramic core comprises a cavity configured to form the flow guide 260. The cavity corresponding to the flow guide 260 is formed similarly to cavities corresponding individual pedestals of the pedestal bank 240, but differs in shape and size as outlined above so as to configure the flow guide 260 for directing cooling flow through the cooling passage 230.

Additionally, the core may define fillet radii for forming connecting adjacent surfaces of the flow guides 260 and the end wall from which they extend.

The flow guide 260 is configured to redirect cooling flow within the cooling passage 230. Even without being physically located in the flow channel 250, the flow guide 260 serves to draw peripheral flow F1 from the flow channel 250 to reduce the amount of cooling flow circumventing the pedestal bank 240. Thus improved cooling is achieved by the pedestal bank 240 and high temperature gradients in the region of the flow channel 250 are avoided.

As the flow guide 260 need not be formed in the flow channel 250, a ceramic core for casting may be structurally strengthened and so casting yield improved.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An internally-cooled turbomachine component, comprising:

a main body comprising:

a first end wall, a second end wall spaced apart from the first end wall, and a sidewall which extends between the first end wall and the second end wall such that the first end wall, the second end wall and the sidewall define a cooling passage extending between a fluid inlet and a fluid outlet, a pedestal bank comprising a plurality of pedestals which span the cooling passage between the first end wall and the second end wall, wherein the pedestal bank is spaced from the sidewall to define a flow channel therebetween; and a flow guide for directing cooling flow away from the flow channel, the flow guide extending from the flow channel into the pedestal bank, wherein the flow guide has a leading edge, a trailing edge and a centre-line, the centre-line intersects both the leading edge and the trailing edge, a tangent of the centre-line at the intersection with the leading edge has an angle θ to the sidewall and/or flow direction in the range 0° to 45°.

2. The turbomachine component according to claim 1, wherein a second tangent of the centre-line at the intersection with the trailing edge has an angle ϕ to the sidewall and/or flow direction in the range 20° to 45°.

3. The turbomachine component according to claim 1, wherein the angle ϕ is greater than or equal to angle θ.

4. The turbomachine component according to claim 1, wherein the pedestal bank comprises a first row of pedestals extending beside the sidewall, the first row adjacent to and spaced apart from the sidewall, and a second row of pedestals extending beside the first row, which is spaced apart from the first row, the first row located adjacent to the sidewall, and wherein the flow guide extends from the first row to the second row.

5. The turbomachine component according to claim 1, wherein the pedestal bank comprises a first column of pedestals and a second column of pedestals, the pedestals of each column generally aligned, and the first column located upstream of the second column, and wherein the flow guide extends from the first column to the second column.

6. The turbomachine component according to claim 1, wherein the flow guide comprises a head portion, a tail portion, and an elongate middle portion extending between the head portion and the tail portion, and wherein the middle portion is configured to define an inner side facing the pedestal bank and an outer side facing the sidewall.

7. The turbomachine component according to claim 6, wherein the elongate middle portion extends a first distance in the flow direction and a second distance perpendicular to the flow direction, wherein the first distance is equal to or greater than the second distance.

8. The turbomachine component according to claim 6, wherein a first section of the inner side is concave.

9. The turbomachine component according to claim 8, wherein a second section of the inner side is convex, the second section provided closer to the tail portion than the head portion section.

10. The turbomachine component according to claim 6, wherein the head portion is provided as a rounded end of the flow guide and the tail portion is provided as a pointed end of the flow guide, the tail portion being located downstream of the head portion.

11. The turbomachine component according to claim 1, wherein the flow guide extends all of the way across the cooling passage between the first end wall and the second end wall.

12. The turbomachine component according to claim 1, wherein the flow guide is spaced apart from the sidewall.

13. The turbomachine component according to claim 12, wherein the sidewall is substantially planar.

14. The turbomachine component according to claim 1, further comprising:

a plurality of flow guides.

15. The turbomachine component according to claim 14, wherein the plurality of flow guides is arranged as a first row of flow guides and optionally a second row of flow guides.

16. The turbomachine component according to claim 15, wherein the plurality of flow guides arranged as the first row of flow guides and/or the second row of flow guides is aligned in the direction parallel to the sidewall and/or in the flow direction.

17. The turbomachine component according to claim 15, wherein a first row of flow guides has a first spacing between neighbouring pedestals in the row, a second row of flow guides has a second spacing between neighbouring pedestals in the row, wherein the first spacing is substantially equal to the second spacing and the first row of flow guides is offset relative to the second row of flow guides by approximately half of the first spacing.

* * * * *